US006715586B1

(12) United States Patent
Shubin

(10) Patent No.: US 6,715,586 B1
(45) Date of Patent: Apr. 6, 2004

(54) UPGRADED ELEVATOR CONTROL CIRCUIT AND METHOD DEALING WITH FIRE DANGER

(76) Inventor: William A. Shubin, 2221 Jose Way, Fullerton, CA (US) 92835

( * ) Notice: Subject to any disclaimer, the term of this patent is extended or adjusted under 35 U.S.C. 154(b) by 0 days.

(21) Appl. No.: 10/128,906

(22) Filed: Apr. 22, 2002

(51) Int. Cl.[7] ..... B66B 13/14
(52) U.S. Cl. ..... 187/316; 49/26
(58) Field of Search ..... 187/316, 317, 187/247; 49/26, 27, 28, 43, 118; 318/66, 71; 388/826, 830, 834, 930

(56) References Cited

U.S. PATENT DOCUMENTS

| | | | | | |
|---|---|---|---|---|---|
| 1,680,771 | A | * | 8/1928 | Davis | 187/284 |
| 3,554,326 | A | * | 1/1971 | Hallene et al. | 187/324 |
| 3,773,145 | A | * | 11/1973 | Drexler | 187/277 |
| 4,101,007 | A | * | 7/1978 | Magee | 187/280 |
| 4,305,481 | A | | 12/1981 | Hmelovsky et al. | |
| 4,376,471 | A | * | 3/1983 | Uchino et al. | 187/290 |
| 4,379,499 | A | * | 4/1983 | Nowak | 187/290 |
| 4,418,795 | A | | 12/1983 | Trosky et al. | |
| 4,561,093 | A | | 12/1985 | Doane et al. | |
| 4,697,243 | A | | 9/1987 | Moore et al. | |
| 4,771,865 | A | | 9/1988 | Hinderling | |
| 4,832,158 | A | | 5/1989 | Farrar et al. | |
| 4,930,604 | A | | 6/1990 | Schienda et al. | |
| 5,042,621 | A | | 8/1991 | Ovaska et al. | |
| 5,257,176 | A | | 10/1993 | Uetani | |
| 5,587,566 | A | | 12/1996 | Barten et al. | |
| 5,616,894 | A | | 4/1997 | Nieminen et al. | |
| 5,780,788 | A | * | 7/1998 | Eschenbrenner et al. | 187/316 |

FOREIGN PATENT DOCUMENTS

| | | |
|---|---|---|
| WO | WO 93/16949 | 9/1993 |

* cited by examiner

*Primary Examiner*—Jonathan Salata
(74) *Attorney, Agent, or Firm*—Gene Scott-Patent Law & Venture Group

(57) ABSTRACT

A method for upgrading an elevator control circuit having a phase 1, alternate and phase 2 input circuits, includes placing a first impedance of a switching device across a door motor armature of the elevator control circuit for enabling a selected door closure speed, and placing a second impedance of the switching device in series with a door motor field of the elevator control circuit for enabling a selected door operating torque. The method further provides a logic circuit enabling the impedances when an input signal is present at, at least one of, the phase 1 and the alternate input circuits; and disabling the impedances when an input signal is present at the phase 2 input circuit.

2 Claims, 5 Drawing Sheets

UPGRADED ELEVATOR CONTROL CIRCUIT AND METHOD DEALING WITH FIRE DANGER

BACKGROUND OF THE INVENTION

1. Field of the Invention

This invention relates generally to elevator control circuitry, and more particularly to a means for setting door operating torque and closing speed according to phase 1, alternate and phase 2 signal status.

2. Description of Related Art

The following art defines the present state of this field:

Hmelovsky et al., U.S. Pat. No. 4,305,481 describes an elevator system including a microprocessor-based cab controller mounted directly on an elevator car, which controls the operation of the elevator door. Elevator door motion is commanded in response to the difference in actual door velocity from a desired, dictated door velocity in accordance with desired rates of acceleration and deceleration, maximum velocity, acceleration and deceleration, the point at which deceleration is to begin, and a velocity at which deceleration is to decrease. The disclosed invention provides selective modification in maximum velocity along with the point at which deceleration is to begin, the velocity at which deceleration is to decrease along with the point at which deceleration is to begin, and/or simply the point where deceleration is to begin, so that door velocity profiles may be tailored to suit any particular door of a given type. An exemplary environment for and details of the present invention are disclosed.

Trosky et al., U.S. Pat. No. 4,418,795 describes an elevator servicing method and apparatus which detects and stores information relative to user-defined intermittent conditions, or other abnormal operating conditions. The stored information is reproduced for evaluation and analysis in a manner selected by the user, such as on a video monitor and/or a printer.

Doane et al., U.S. Pat. No. 4,561,093 describes a computer-controlled system, such as an elevator, that is tested by augmenting computer operation with a diagnostic device containing a computer and coded diagnostic programs that a service technician identifies through a keyboard using diagnostic test codes that appear on an overlay which contains special codes and identifiers associated with numerical displays and lights on the diagnostic device for correlating test results to the test performed according to the program.

Moore et al., U.S. Pat. No. 4,697,243 describes a method of integrating an expert system having a knowledge base of elevator trouble-shooting information into the working environment of elevator service personnel, without special training of such personnel, and without compromising the security of the knowledge base. The method includes an interactive initialization procedure which includes successive, successful user and knowledge base initiated communication links between the user and knowledge base, before actual access to the knowledge base is permitted.

Hinderling, U.S. Pat. No. 4,771,865 describes a system for remote management including central management, planning and rationalization of the upkeep of elevator installations. The system comprises a modularly constructed remote management system, which makes possible the management centrally, the inspection regionally and the monitoring of decentralized processes locally of elevator installations. The management exchange is connected by modem and telephone network with the regional exchanges and has access to all relevant data. The regional exchange permits an inspection of all processes of several buildings. Direct speech connections with all the peripheral devices are by means or remote alarms from the regional exchange. For each building, a communications module manages the data traffic between the regional exchange and the processes to be inspected in the building. The process data is detected by a peripheral module, which is capable of diagnosis, and is processed further into relevant operational, fault and alarm reports with the aid of heuristic operating means. The peripheral module reports diagnostic data by way of the common building bus to the communications module, which transmits the data to the regional exchange by means of automatic telephone dialing.

Farrar et al., U.S. Pat. No. 4,832,158 describes an elevator system having a door operator with a door operator motor and a dedicated microprocessor for storing door open and door close cycles. The microprocessor initiates door open and close cycles responsive to external door open and door close commands. Preferably the microprocessor stores a plurality of door closed cycles in which the elevator controller selects one of the cycles when issuing a door closed command.

Schienda et al., U.S. Pat. No. 4,930,604 describes an apparatus connected by way of a serial communication link to at least one computer-based elevator controller in order to monitor the diagnostic output of each connected controller. The diagnostic output of a controller is determined in a manner by which the elevator system is modeled as normally operating sequentially from state to state in a closed loop sequence of linked operating states. Any deviations from this sequence generate diagnostic messages that are communicated from the controller to the monitoring apparatus. Also communicated are the last to occur of a plurality of parameter signal state changes. The monitoring apparatus processes the diagnostic signals for visual and/or hard copy display to interested elevator personnel in a meaningful way. Further, the monitoring apparatus provides a plurality of signals to the elevator controller indicative of corresponding reference standards that the elevator controller utilizes in determining the occurrence of certain elevator event conditions.

Ovaska et al., U.S. Pat. No. 5,042,621 describes a method and apparatus for the measurement and tuning of an elevator system including at least one elevator having an elevator car and its control and driving equipment. The method uses at least one computer connected to the system. The elevator system is measured and tuned using virtual measuring and tuning components operated by programs of the computer.

Uetani, U.S. Pat. No. 5,257,176 describes an apparatus for setting a control operation specification for an elevator. The apparatus includes an operation specification storage device for storing a plurality of operation specifications used to control the elevator, a setting condition storage device for storing setting conditions, a display device for displaying the operation specifications as well as the setting conditions which determine how the operation specifications can be modified, an input device for inputting a modified operation specification, and a determination device for determining whether or not the operation specification stored in the operation specification storage device can be modified to the operation specification which has been input from the input device on the basis of the setting conditions stored in the setting condition storage device and the present operation specification.

Barten et al., U.S. Pat. No. 5,587,566 describes a method for adjusting an elevator door including the steps of selecting an elevator door adjustment task from a task list which is provided by an elevator door controller. The elevator door controller is adapted to control the phase, voltage and torque of an elevator door motor. The controller is provided with an elevator door adjustment program which is adapted to provide a set of program prompts to a service person who inputs elevator door parameters in response to the set of program prompts. The parameters are then stored in a memory accessible to said elevator door controller the elevator door in thereafter controlled in accordance with the inputted parameters.

Nieminen et al., U.S. Pat. No. 5,616,894 describes a procedure that supplies and modifies the data required in the control system of an elevator and for displaying the instructions needed for installation, maintenance and adjustment on a display comprised in the control system. The parameter data of the elevator control system and the instructions for each person carrying out maintenance work are stored in a separate storage unit. When modification or maintenance work is being carried out, a communication link is established between the storage unit and the data storage means of a control unit included in the control system. The data stored in the storage unit is read and saved in the control unit and the modifications and actions required by the data read from the storage unit are carried out in the control unit.

Ludwig, WO93/16949 describes a start-up procedure for, and device for operating, a controlled-operation sliding door, in particular a lift door. The procedure is intended for post-installation start-up purposes or for start-up after a repair involving a change in the operating conditions, as well as for subsequent operation of the door. The door has a drive motor with a digital pulse generator, the door further having a programmable electronic control unit. The control unit determines the door parameters itself by carring out specified test runs and fees the results to a non-volatile memory, e.g. a serial EE-PROM, for use as door-control parameters.

The prior art teaches elevator door motion modification, servicing methods, control via software, remote installation management, microprocessor door operation, diagnostic management, tuning an elevator system, control operation setting, door adjustment, handling control data. However, the prior art does not does not appear to teach the use of a circuit to upgrade an elevator control circuit using controlled switching of impedances into the field and armature of an elevator door control circuit, and coupled therewith, a logic circuit for applying the impedances according to the appearance of phase 1, alternate and phase 2 signals. The present invention fulfills these needs and provides further related advantages as described in the following summary.

SUMMARY OF THE INVENTION

The present invention teaches certain benefits in construction and use which give rise to the objectives described below.

The invention is a method for upgrading an elevator control circuit having a phase 1, alternate and phase 2 input circuits, and includes placing a first impedance of a switching means across a door motor armature of the elevator control circuit for enabling a selected door closure speed, and placing a second impedance of the switching means in series with a door motor field of the elevator control circuit for enabling a selected door operating torque. The method further provides a logic circuit enabling the impedances when an input signal is present at, at least one of, the phase 1 and the alternate input circuits; and disabling the impedances when an input signal is present at the phase 2 input circuit.

A primary objective of the present invention is to provide an apparatus and method of use of such apparatus that provides advantages not taught by the prior art.

Another objective is to provide such an invention capable of being used with existing elevator control circuits to upgrade such circuits to meet current code standards.

A further objective is to provide such an invention capable of a highly simplified and fast installation.

A still further objective is to provide such an invention capable of controlling selected auxiliary circuit functions.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawing sheets illustrate the present invention. In such drawings.

DETAILED DESCRIPTION OF THE INVENTION

The above described drawing figures illustrate the invention in at least one of its preferred embodiments, which is further defined in detail in the following description.

Figure 1A:
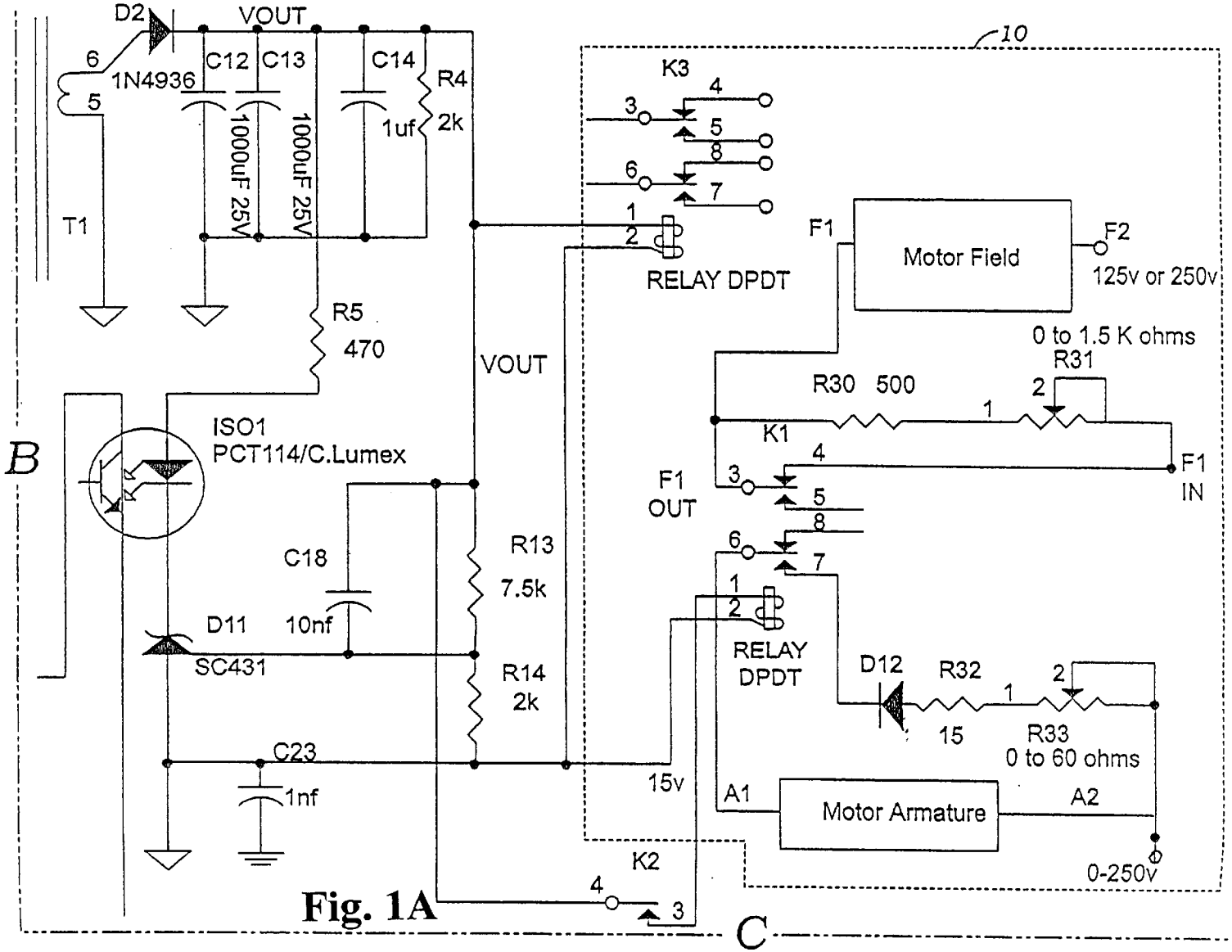
FIGS. 1A–1D is an electrical schematic diagram of the invention, and appears on four separate and contiguous drawing sheets which may be matched along lines A, B, C and D.
Figure 1B:
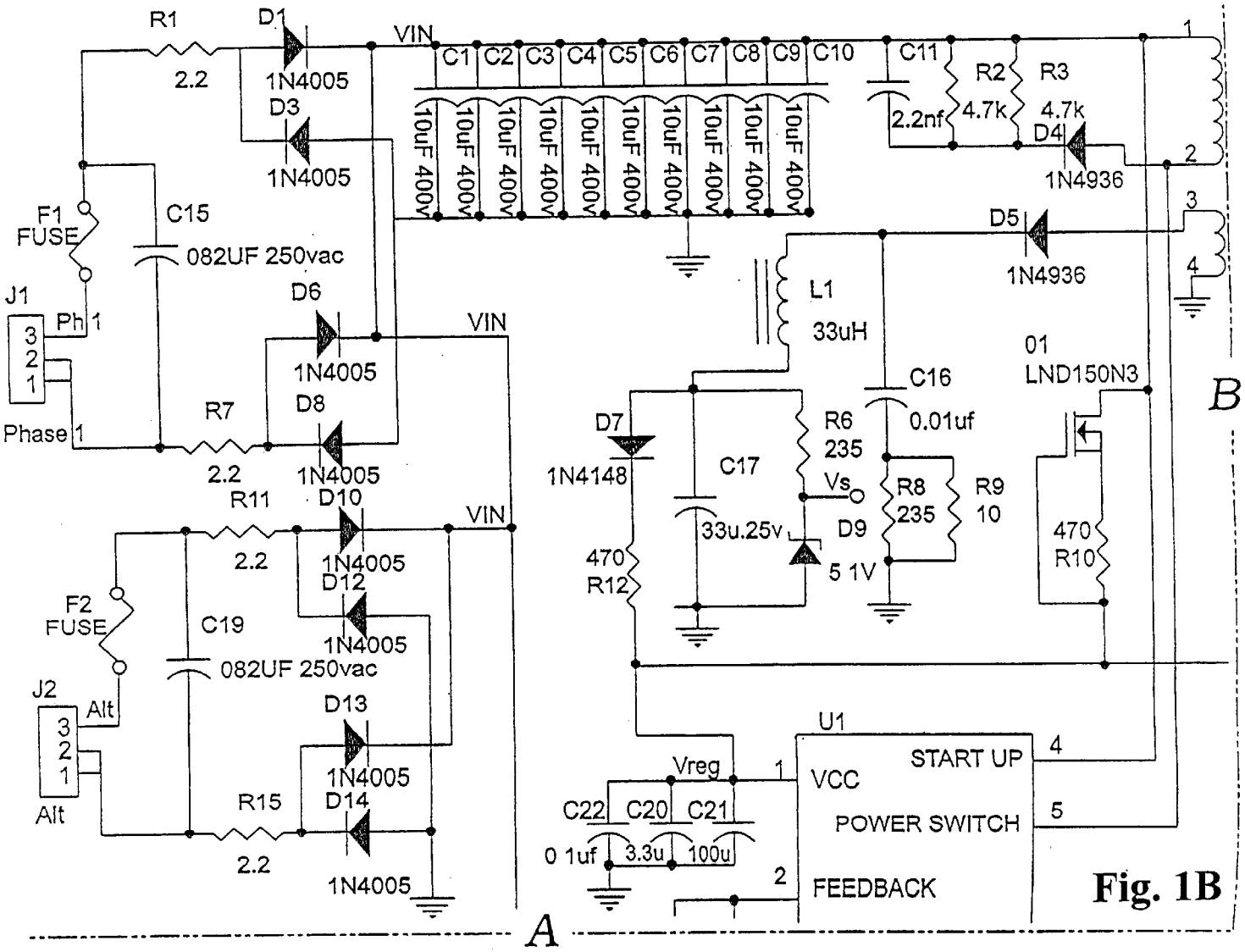
Figure 1C:
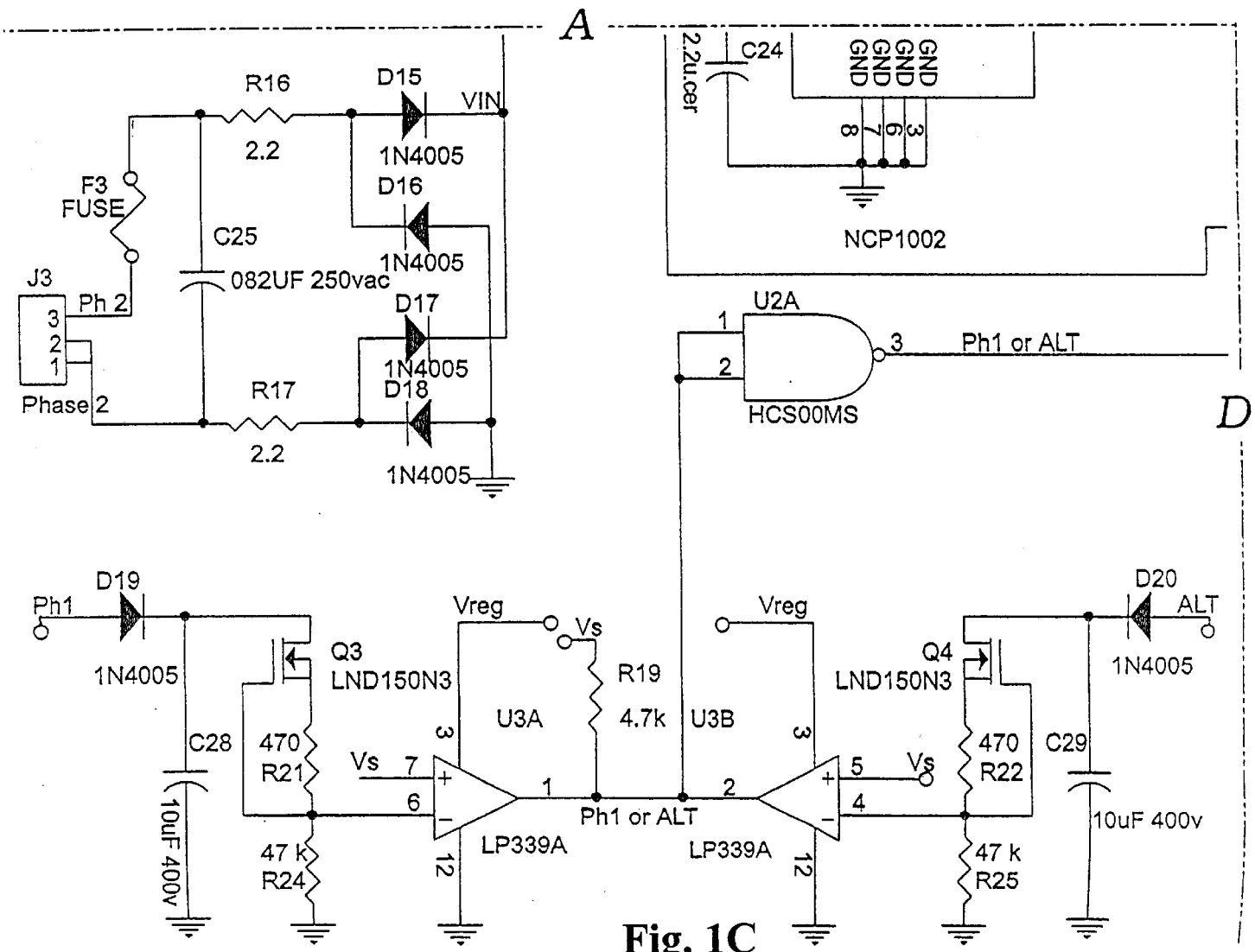
Figure 1D:
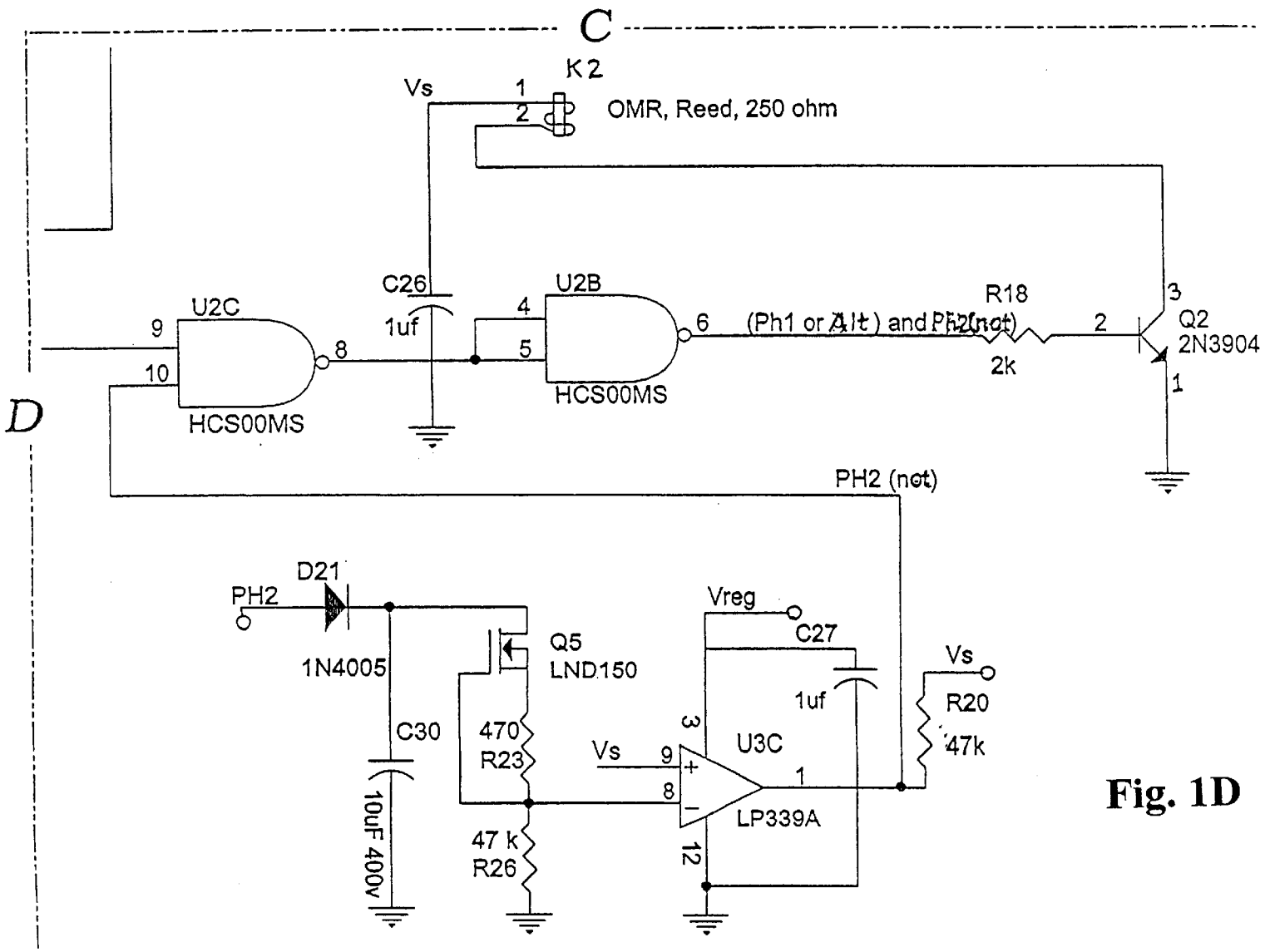
Figure 2:
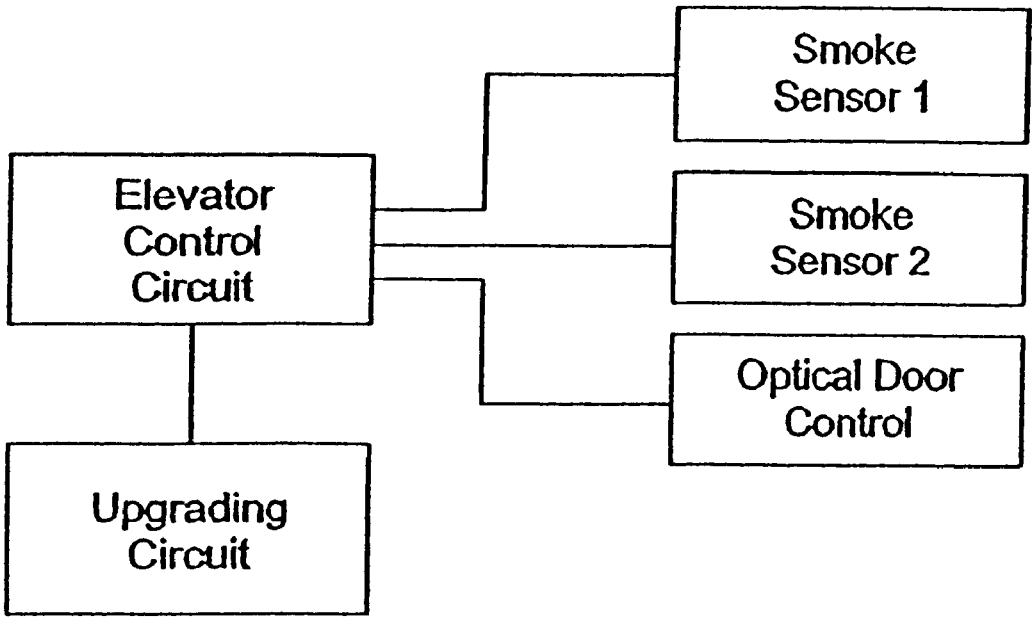
FIG. 2 is a block diagram showing the elements of the claims which are not shown in FIG. 1, including the smoke sensors, and optical door control.

The present invention is a method of elevator control. Typical elevators operate to code (Code) requirements that provide for automatic control of the elevator's movements upon detection of smoke. Should smoke be detected on any floor of a building except the lobby, a signal is provided at an input, defined as "phase 1" input, of the elevator control circuit. This condition immediately closes the doors of the elevator and moves the elevator automatically to the lobby, or equivalent, and then opens the elevator doors and holds the elevator in that position until manual override occurs. Should smoke be detected on the lobby, a signal is provided at an input, defined as "alternate" input, of the elevator control circuit. This condition immediately closes the doors of the elevator and moves the elevator automatically to an alternate floor of the building, generally at least two floor removed from the lobby, or equivalent, and then opens the elevator doors and holds the elevator in that position until manual override occurs. A third input, the "phase 2" input enables manual override of the elevator's function. The method comprising the steps of providing an elevator control circuit, see FIG. 1, having a phase 1, see J1, alternate, see J2, and phase 2, see, J3, input circuits, as shown on sheets 2 and 3 of 4, placing a first impedance R32, of a switching means 10, across a door motor armature of the elevator control circuit for enabling a selected door closure speed, and placing a second impedance R31, of the switching means 10 in series with a door motor field of the elevator control circuit for enabling a selected door operating torque. This is shown on sheet 1 of 4. The method further logically enables these impedances when an input signal is present at, at least one of, the phase 1 and the alternate input circuits.

Thus, when smoke or fire are present, the elevator doors move selectively more slowly, thereby enabling passengers to embark and disembark the elevator car, and also the doors have reduced torque so that they may be manually overpowered by a person in door closure path when a phase 1 or an alternate state occurs. The impedances are disabled when an input signal is present at the phase 2 input circuit which results generally when a key is manually inserted to make the phase 2 circuit. In this case, the operation of the car is in the hands of a trained personnel and slowly moving and low torque doors are not desirable.

A The method includes the further step of providing circuit closure means such as shown by relay K3, integrated with the elevator control circuit and enabled for selecting chosen operating functions in accordance with input signal status at the phase 1, alternate, and phase 2 inputs. It should be noted that modern elevator door retract triggering is primarily based on optical sensing. Heavy smoke can therefore prevent elevator doors from closing. Thus, the present invention provides relay K3 which is advantageously wired for disabling normal optical door sensors when phase 1 or alternate conditions occur.

The invention apparatus functions in conjunction with a broad range of elevator systems and it is designed to make it simple for the installer to adjust door speed and torque quickly and easily without job surveys and without undue on-site engineering. This permits faster and easier maintenance of elevators and upgraded operation. The unit accepts AC or DC power inputs over the range of 17 to 270 volts. This is shown in the lower right corner of sheet 1/4 of FIG. 1. Upon receiving a phase 1 signal the unit will reduce the speed and the torque of an elevator door motor to comply with Code requirements. Referring further to FIG. 1, a phase-one input (J1) turns on a switching line regulator including D1, 3, 6 and 8, which functions as a 12 volt DC power source. This source energizes a 12 volt DC relay K1, comprising two, form-C contacts that are used to override the elevator's door protection circuit (not shown), which is normally activated by a detector in accordance with Code. If there is voltage present at either: phase one, wherein the elevator is recalled to a designated floor, alternate, where the elevator is recalled to an alternate floor, or phase two enabling manual override, the 12 volt supply is made present at any or all of those, and the 12 volt relay is energized. When voltage is present at phase one or alternate recall, through the. TTL transistor logic circuit shown on the lower half of sheets 3/4 and 4/4 of FIG. 1, a signal turns on a five volt DC read relay K2, which in turn uses the same 12 volt DC power supply as previously described, to turn on a second two-pole relay K1. K1 assures that resistance R33 is inserted across the elevator door motor armature to shunt out and reduce the speed of the motor. The second set of form C contacts are normally open so that when the elevator door motor is functioning under normal conditions it is effected only when this signal is triggered in the on position. The second contact is a normally closed contact placed in series with the DC motor fields to weaken the fields and reduce the torque if necessary. So if voltage is present, on phase one input or alternate input, then both relays are actuated. Upon phase two input, wherein after the elevator is recalled and the doors are opened, key actuation is made placing the elevator in phase 2, i.e., manual operation. The TTL logic turns off the five volt DC read relay K2, leaves the first relay on for disabling the door protection, and puts the elevator door motor back into the normal operation. When all the signals are removed, everything goes back to normal door protection.

Input on the phase one, alternate or phase two input2 will turn on the switching regulator; the NCP1002, providing a regulated 12 volt DC out. If voltage is present at the phase one alternate or phase two input, a key may be used to disable door protection and/or send a signal. Upon phase actuation, with phase one, through the TTL logic, the 5 volt DC reed relay K2 will turn on, closing contacts 3 and 4 actuating K1 relay. K1 in turn, will insert the resistance to the door fields and the shunting of the door motor armature. If phase 2 comes on through the TTL logic, it will switch off the K2 and K1 relays and the doors will go back to normal operation with no shunting and no interruption of the door motor field but K3 will stay energized until all power is removed and the system comes off emergency status. This allows the actuation of other elements including audible alarms, lights, etc.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An upgraded elevator control apparatus functional in a building and comprising in combination: an elevator control circuit having a phase 1, alternate and phase 2 input circuits; and an upgrading circuit; the upgrading circuit providing a switching means enabled for placing a first variable impedance across a door motor armature of the elevator control circuit thereby enabling a selected door closure speed; the switching means further enabled for placing a second variable impedance in series with a door motor field of the elevator control circuit thereby enabling a selected door operating torque; the upgrading circuit further providing a means for logically enabling the first and second variable impedances when an input signal is present at, at least one of the phase 1 and the alternate input circuits of the elevator control circuit, and for logically disabling the first and second variable impedances when an input signal is present at the phase 2 input circuit of the elevator control circuit, the apparatus further comprising means for sensing smoke on at least two floors of the building and for communicating with the logically enabling means for overriding optical door control and enabling the first and second impedances when smoke is sensed on at least one of the at least two floors of the building.

2. An upgraded elevator control method functional in a building and comprising the steps of: providing an elevator control circuit having a phase 1, alternate and phase 2 input circuits; providing an upgrading circuit including a switching means; enabling the switching means for placing a first variable impedance across a door motor armature of the elevator control circuit thereby selecting a door closure speed; enabling the switching means further for placing a second variable impedance in series with a door motor field of the elevator control circuit thereby selecting a door operating torque; providing an input signal at, at least one of the phase 1 and the alternate input circuits of the elevator control circuit so as to enable the first and second variable impedances; providing an input signal at the phase 2 input circuit of the elevator control circuit so as to logically disable the first and second variable impedances; further providing a means for sensing smoke on at least two floors of the building; overriding optical door control and enabling the first and second impedances when smoke is sensed on at least one of the at least two floors of the building.

* * * * *